US009127865B2

(12) United States Patent
Choi et al.

(10) Patent No.: US 9,127,865 B2
(45) Date of Patent: Sep. 8, 2015

(54) AIR CONDITIONING SYSTEM INCLUDING A BYPASS PIPE

(75) Inventors: Song Choi, Seoul (KR); Yun Ho Ryu, Seoul (KR); Baik Young Chung, Seoul (KR); Kyung Won Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1229 days.

(21) Appl. No.: 12/453,215

(22) Filed: May 1, 2009

(65) Prior Publication Data

US 2010/0051229 A1 Mar. 4, 2010

(30) Foreign Application Priority Data

Aug. 27, 2008 (KR) ..... 10-2008-0083629

(51) Int. Cl.
*F25B 29/00* (2006.01)
*F25B 13/00* (2006.01)
*F25B 41/04* (2006.01)

(52) U.S. Cl.
CPC ..... *F25B 13/00* (2013.01); *F25B 41/04* (2013.01); *F25B 2313/008* (2013.01); *F25B 2313/0233* (2013.01); *F25B 2313/02741* (2013.01); *F25B 2341/066* (2013.01); *F25B 2400/04* (2013.01); *F25B 2400/19* (2013.01)

(58) Field of Classification Search
CPC ..... F25D 31/005; F25B 27/00; F24F 3/10; F24F 3/08; F24F 3/06; F24F 3/065; F24F 11/08; F24D 10/006; F24D 19/1021
USPC ..... 165/61, 62, 63, 220, 221
See application file for complete search history.

(56) References Cited

U.S. PATENT DOCUMENTS

| | | | | | |
|---|---|---|---|---|---|
| 2,268,048 | A | * | 12/1941 | McElgin | 236/37 |
| 3,188,829 | A | * | 6/1965 | Siewert et al. | 62/160 |
| 3,195,622 | A | * | 7/1965 | Greene, Jr. et al. | 165/101 |
| 3,308,877 | A | * | 3/1967 | Gerteis | 165/62 |
| 3,378,062 | A | * | 4/1968 | Ringquist et al. | 165/221 |
| 4,012,920 | A | * | 3/1977 | Kirschbaum | 62/235.1 |
| 4,018,581 | A | * | 4/1977 | Ruff et al. | 62/235.1 |
| 4,067,383 | A | * | 1/1978 | Padden | 165/247 |
| 4,098,092 | A | * | 7/1978 | Singh | 62/238.6 |
| 4,100,755 | A | * | 7/1978 | Leonard | 62/238.3 |
| 4,111,259 | A | * | 9/1978 | Lebduska | 62/235.1 |
| 4,165,037 | A | | 8/1979 | McCarson | |
| 4,179,894 | A | * | 12/1979 | Hughes | 62/79 |
| 4,187,687 | A | * | 2/1980 | Savage | 62/238.2 |
| 4,228,846 | A | * | 10/1980 | Smorol | 165/240 |
| 4,256,475 | A | * | 3/1981 | Schafer | 62/235.1 |
| 4,257,238 | A | * | 3/1981 | Kountz et al. | 62/228.1 |
| 4,313,307 | A | * | 2/1982 | Sisk | 62/79 |
| 4,336,692 | A | * | 6/1982 | Ecker et al. | 62/235.1 |
| 4,353,409 | A | * | 10/1982 | Saunders et al. | 165/240 |

(Continued)

FOREIGN PATENT DOCUMENTS

| | | |
|---|---|---|
| CN | 1205073 | 1/1999 |
| CN | 1311210 C | 7/2005 |

(Continued)

*Primary Examiner* — Ljiljana Ciric
(74) *Attorney, Agent, or Firm* — Dentons US LLP

(57) ABSTRACT

An air conditioning system includes a compressor, an outdoor heat exchanger that discharges evaporated refrigerant, and a first pipe coupling the outdoor heat exchanger and the compressor, where the first pipe allows the outdoor heat exchanger to receive at least a portion of the compressed refrigerant from the compressor.

14 Claims, 5 Drawing Sheets

(56) References Cited

U.S. PATENT DOCUMENTS

| | | | | | |
|---|---|---|---|---|---|
| 4,441,331 | A | * | 4/1984 | Yuyama | 62/196.3 |
| 4,441,901 | A | * | 4/1984 | Endoh | 62/238.7 |
| 4,516,408 | A | * | 5/1985 | Chiba | 62/238.7 |
| 4,614,090 | A | * | 9/1986 | Kaneko et al. | 62/158 |
| 4,644,756 | A | * | 2/1987 | Sugimoto et al. | 62/160 |
| 4,645,908 | A | * | 2/1987 | Jones | 165/63 |
| 4,693,089 | A | * | 9/1987 | Bourne et al. | 62/238.6 |
| 4,787,444 | A | * | 11/1988 | Countryman | 165/48.2 |
| 4,869,074 | A | * | 9/1989 | Hoshi et al. | 62/238.7 |
| 4,876,856 | A | * | 10/1989 | Iishiki et al. | 62/238.4 |
| 4,878,357 | A | * | 11/1989 | Sekigami et al. | 62/228.4 |
| 4,920,750 | A | * | 5/1990 | Iishiki et al. | 60/671 |
| 4,987,747 | A | * | 1/1991 | Nakamura et al. | 62/324.6 |
| 5,029,449 | A | * | 7/1991 | Wilkinson | 62/175 |
| 5,063,752 | A | * | 11/1991 | Nakamura et al. | 62/324.6 |
| 5,107,684 | A | * | 4/1992 | Nakayama et al. | 62/324.6 |
| 5,142,879 | A | * | 9/1992 | Nakamura et al. | 62/324.6 |
| 5,156,014 | A | * | 10/1992 | Nakamura et al. | 62/160 |
| 5,159,817 | A | * | 11/1992 | Hojo et al. | 62/81 |
| 5,161,388 | A | * | 11/1992 | Fujita et al. | 62/175 |
| 5,163,503 | A | * | 11/1992 | Inoue | 165/231 |
| 5,237,833 | A | * | 8/1993 | Hayashida et al. | 62/324.6 |
| 5,239,838 | A | * | 8/1993 | Tressler | 62/235.1 |
| 5,263,333 | A | * | 11/1993 | Kubo et al. | 62/160 |
| 5,272,885 | A | * | 12/1993 | Watanabe | 62/184 |
| 5,277,034 | A | * | 1/1994 | Hojo et al. | 62/160 |
| 5,297,392 | A | * | 3/1994 | Takata et al. | 62/160 |
| 5,309,728 | A | * | 5/1994 | Chae | 62/158 |
| 5,309,733 | A | * | 5/1994 | Hayashida et al. | 62/278 |
| 5,320,166 | A | * | 6/1994 | Swenson | 165/236 |
| 5,366,153 | A | * | 11/1994 | Swenson | 165/236 |
| 5,370,307 | A | * | 12/1994 | Uehra | 237/2 B |
| 5,381,671 | A | * | 1/1995 | Saito et al. | 62/430 |
| 5,388,422 | A | * | 2/1995 | Hayashida et al. | 62/211 |
| 5,461,876 | A | * | 10/1995 | Dressler | 62/238.7 |
| 5,526,649 | A | * | 6/1996 | Sada | 62/175 |
| 5,548,968 | A | * | 8/1996 | Sada | 62/175 |
| 5,628,200 | A | * | 5/1997 | Pendergrass | 62/197 |
| 5,761,921 | A | * | 6/1998 | Hori et al. | 62/238.4 |
| 5,878,810 | A | | 3/1999 | Saito et al. | |
| 6,126,080 | A | * | 10/2000 | Wada | 62/175 |
| 6,735,969 | B2 | * | 5/2004 | Kasagi et al. | 62/238.7 |
| 6,883,345 | B2 | * | 4/2005 | Lee | 62/324.6 |
| 7,243,505 | B2 | * | 7/2007 | Cho et al. | 62/238.7 |
| 7,308,800 | B2 | * | 12/2007 | Park et al. | 62/159 |
| 7,395,677 | B2 | * | 7/2008 | Fujiyoshi et al. | 62/324.1 |
| 7,451,611 | B2 | * | 11/2008 | Muscatell | 62/235.1 |
| 7,493,775 | B2 | * | 2/2009 | Shimamoto et al. | 62/199 |
| 7,716,941 | B2 | * | 5/2010 | Park et al. | 62/87 |
| 7,954,333 | B2 | * | 6/2011 | Yoshimi | 62/129 |
| 7,984,620 | B2 | * | 7/2011 | Shimamoto et al. | 62/324.1 |
| 8,001,802 | B2 | * | 8/2011 | Choi et al. | 62/332 |
| 8,109,111 | B2 | * | 2/2012 | Yamada | 62/324.1 |
| 8,220,280 | B2 | * | 7/2012 | Chang et al. | 62/149 |
| 8,261,569 | B2 | * | 9/2012 | Choi et al. | 62/324.6 |
| 8,281,614 | B2 | * | 10/2012 | Koo et al. | 62/506 |
| 8,418,494 | B2 | * | 4/2013 | Shinozaki et al. | 62/324.1 |
| 8,752,397 | B2 | * | 6/2014 | Yamashita et al. | 62/151 |
| 2003/0014988 | A1 | | 1/2003 | Watanabe et al. | |
| 2003/0041609 | A1 | * | 3/2003 | Kasagi et al. | 62/238.7 |
| 2003/0070445 | A1 | * | 4/2003 | Kasagi et al. | 62/238.7 |
| 2006/0037346 | A1 | * | 2/2006 | Cho et al. | 62/323.1 |
| 2006/0037352 | A1 | * | 2/2006 | Cho et al. | 62/323.3 |
| 2006/0070719 | A1 | * | 4/2006 | Kim et al. | 165/61 |
| 2006/0254294 | A1 | * | 11/2006 | Shimamoto et al. | 62/238.7 |
| 2007/0012058 | A1 | * | 1/2007 | Cho et al. | 62/238.7 |
| 2007/0180844 | A1 | * | 8/2007 | Fujiyoshi et al. | 62/271 |
| 2008/0196432 | A1 | * | 8/2008 | Shimamoto et al. | 62/238.7 |
| 2008/0271881 | A1 | * | 11/2008 | Blecker | 165/254 |
| 2009/0255284 | A1 | * | 10/2009 | Yoshimi | 62/149 |
| 2014/0230473 | A1 | * | 8/2014 | Yamashita et al. | 62/156 |

FOREIGN PATENT DOCUMENTS

| | | | |
|---|---|---|---|
| CN | 1776325 | A | 5/2006 |
| EP | 1 645 817 | | 4/2006 |
| EP | 1 647 783 | | 4/2006 |
| JP | 08-166175 | | 6/1996 |
| JP | 09-138024 | | 5/1997 |
| JP | 2005-016805 | A | 1/2005 |
| JP | 2007-051820 | A | 3/2007 |

* cited by examiner

AIR CONDITIONING SYSTEM INCLUDING A BYPASS PIPE

CROSS-REFERENCE TO RELATED APPLICATIONS

The present application claims priority under 35 U.S.C. 119 and 35 U.S.C. 365 to Korean Patent Application No. 10-2008-0083629 (filed on Aug. 27, 2008), which is hereby incorporated by reference in its entirety.

BACKGROUND

The present disclosure relates to an air conditioning system, and more particularly, to an air conditioning system that can be used for both cooling and heating.

In general, an air conditioning system includes a compressor, a four-way valve, an indoor heat exchanger, and an outdoor heat exchanger that are used to perform heat exchange cycles for cooling or heating an indoor area. In heating mode, the outdoor heat exchanger is operated as an evaporator, and the indoor heat exchanger is operated as a condenser. In detail, indoor heating is performed as follows: while refrigerant is evaporated in the outdoor heat exchanger, heat is exchanged between the refrigerant and outdoor air; the refrigerant is then compressed to a high-temperature and high-pressure state by the compressor; and while the compressed refrigerant is condensed at the indoor heat exchanger, heat is exchanged between the refrigerant and indoor air.

A refrigerant heating device can be used to heat the refrigerant evaporated in the outdoor heat exchanger in heating mode. That is, in the case where refrigerant is not smoothly evaporated in the outdoor heat exchanger due to a very low outdoor temperature, the refrigerant is heated before the refrigerant is transferred to the compressor. In more detail, refrigerant condensed at the indoor heat exchanger is evaporated at the outdoor heat exchanger or heated by the refrigerant heating device, and the refrigerant is transferred to the compressor.

SUMMARY

Embodiments provide an air conditioning system in which refrigerant is not accumulated in an outdoor heat exchanger in heating mode.

In one embodiment, an air conditioning system includes a compressor; an outdoor heat exchanger that discharges evaporated refrigerant; and a first pipe coupling the outdoor heat exchanger and the compressor, where the first pipe allows the outdoor heat exchanger to receive at least a portion of the compressed refrigerant from the compressor.

In another embodiment, an air conditioning system includes an outdoor heat exchanger; a compressor; a heater; a first pipe coupling the outdoor heat exchanger and the heater; and a second pipe coupling the first pipe and the compressor.

According to the present disclosure, the air conditioning system can be operated more stably.

The details of one or more embodiments are set forth in the accompanying drawings and the description below. Other features will be apparent from the description and drawings, and from the claims.

DETAILED DESCRIPTION OF THE EMBODIMENTS

An air conditioning system will now be described in more detail with reference to the accompanying drawings according to a first embodiment.

Figure 1:
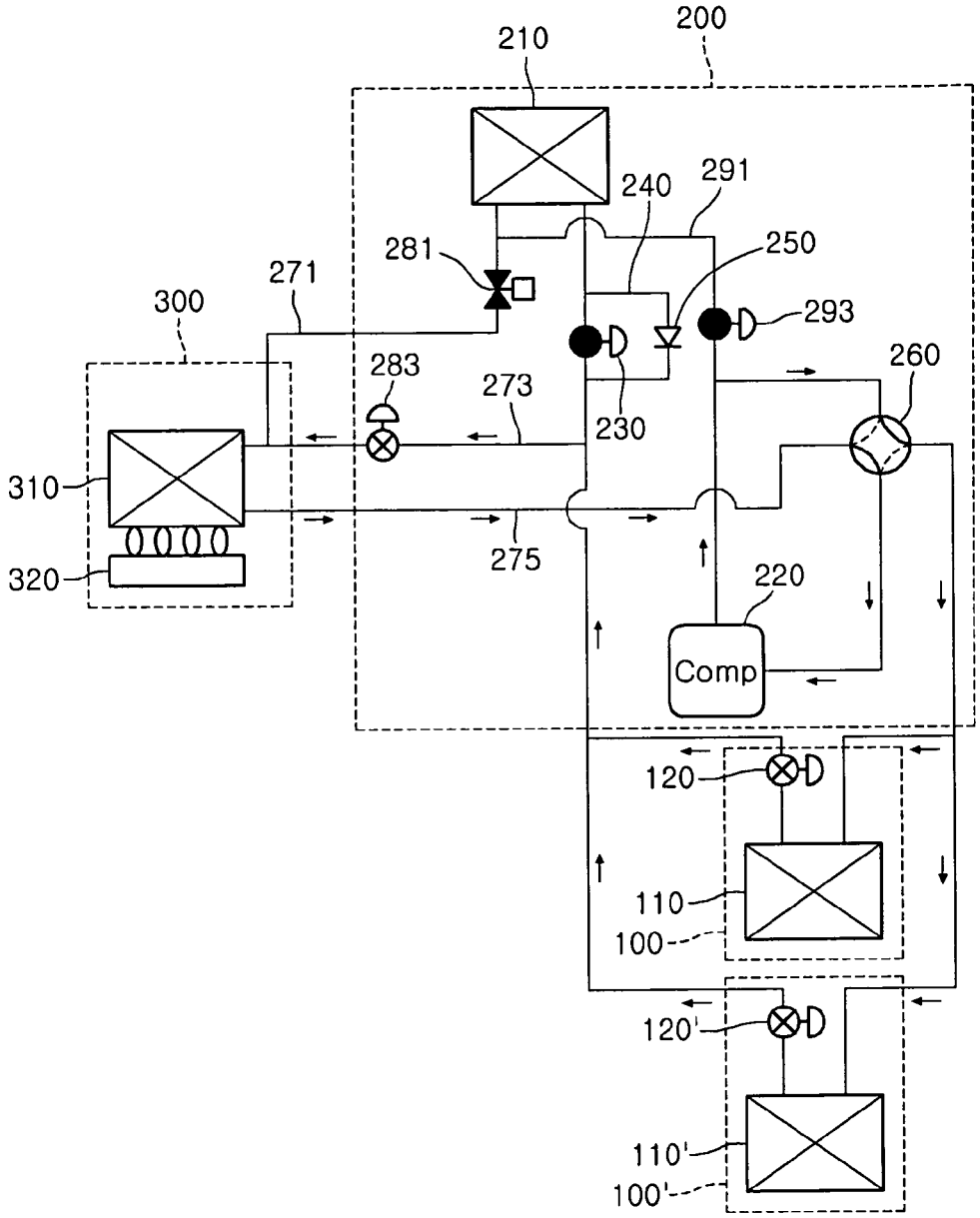
FIGS. 1 and 2 are views for illustrating flows of refrigerant in an air conditioning system when the air conditioning system is operated in heating mode according to a first embodiment.
Figure 2:
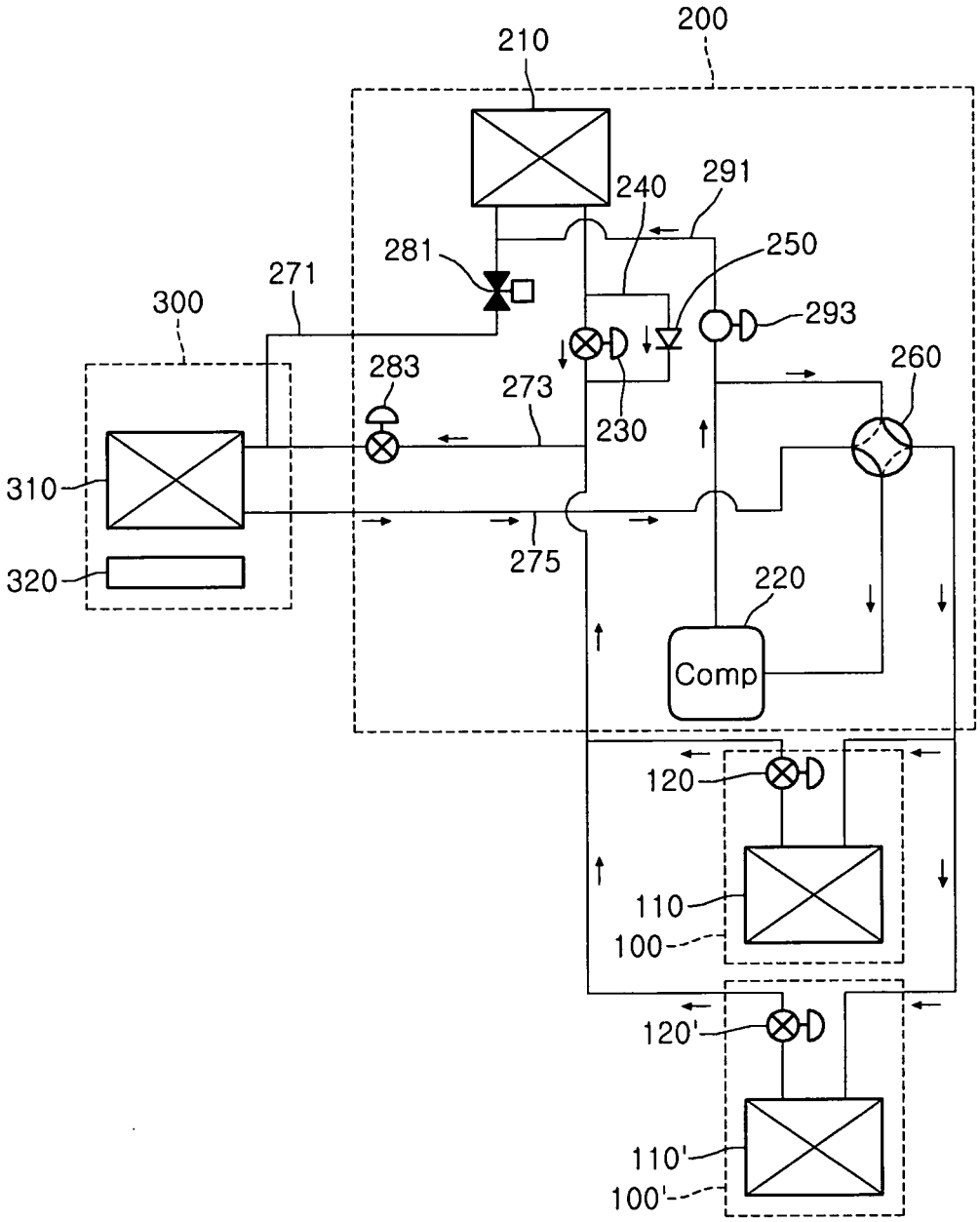
Figure 3:
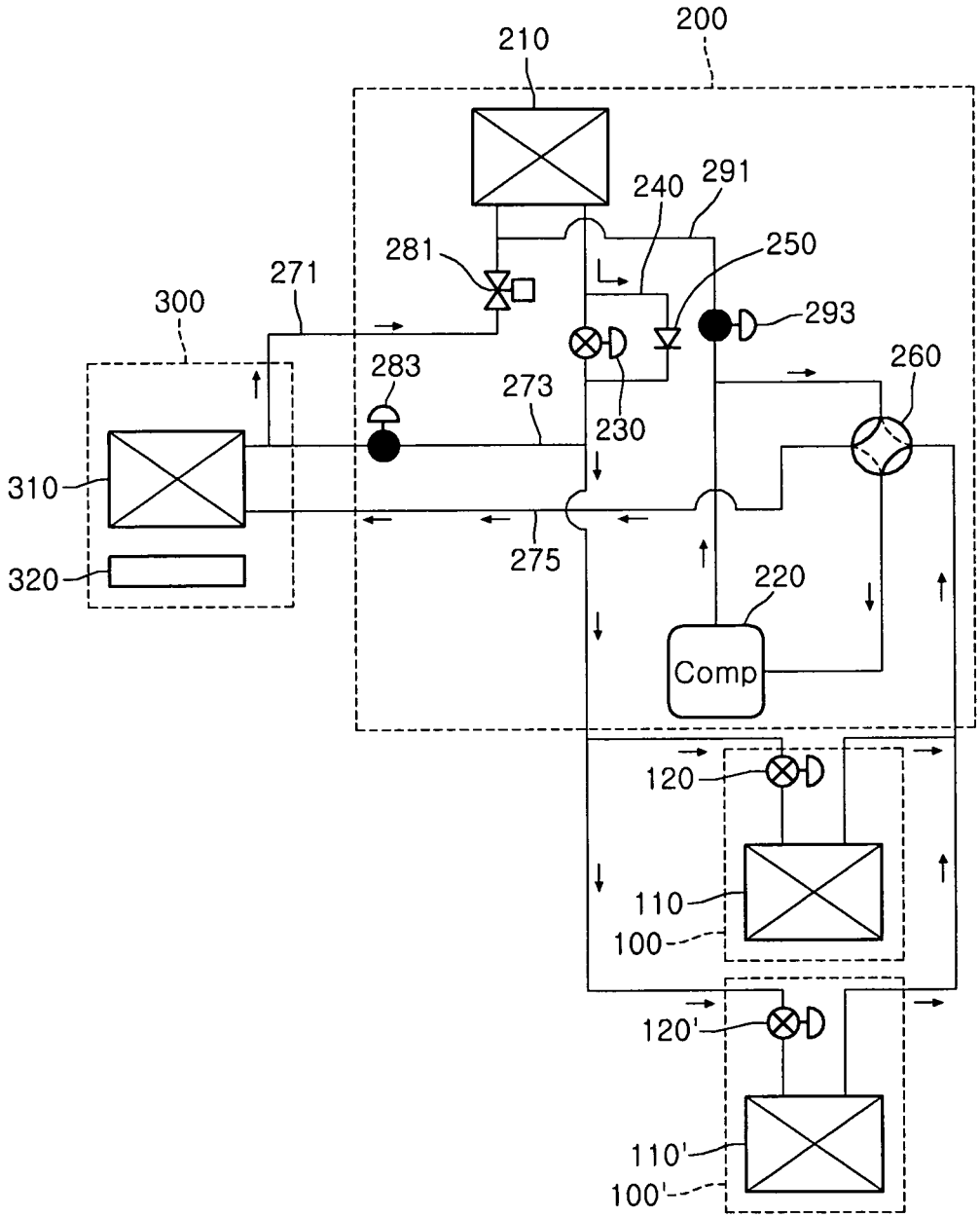
FIG. 3 is a view for illustrating flows of refrigerant in the air conditioning system when the air conditioning system is operated in cooling mode according to the first embodiment.

FIGS. 1 and 2 are views for illustrating flows of refrigerant in an air conditioning system when the air conditioning system is operated in heating mode according to a first embodiment, and FIG. 3 is a view for illustrating flows of refrigerant in the air conditioning system when the air conditioning system is operated in cooling mode according to the first embodiment.

Referring to FIGS. 1 to 3, the air conditioning system is used to cool or heat an indoor area through heat exchange cycles in which refrigerant exchanges heat with indoor air and outdoor air. The air conditioning system includes a plurality of indoor units 100 and 100', and an outdoor unit 200, and a refrigerant heating device 300.

In more detail, the indoor units 100 and 100' include indoor heat exchangers 110 and 110', respectively. The indoor heat exchangers 110 and 110' are operated as condensers in heating mode and evaporators in cooling mode. That is, in heating mode, the indoor heat exchangers 110 and 110' receive refrigerant compressed by a compressor 220 (described later) and condense the refrigerant. In cooling mode, the indoor heat exchangers 110 and 110' receive refrigerant condensed by an outdoor heat exchanger 210 and evaporate the refrigerant.

The indoor units 100 and 100' further include linear expansion valves (LEVs) 120 and 120', respectively. In cooling mode, the linear expansion valves 120 and 120' of the indoor units 100 and 100' are used to expand refrigerant evaporated by the indoor heat exchangers 110 and 110'. In heating mode, the linear expansion valves 120 and 120' of the indoor units 100 and 100' are opened so that refrigerant can pass through the linear expansion valves 120 and 120'.

The outdoor heat exchanger 210 is included in the outdoor unit 200. The outdoor heat exchanger 210 is operated as an evaporator in heating mode and a condenser in cooling mode. In other words, in heating mode, the outdoor heat exchanger 210 evaporates refrigerant condensed by the indoor heat exchangers 110 and 110' and transfers the evaporated refrigerant to the compressor 220. In cooling mode, the outdoor heat exchanger 210 condenses refrigerant and transfers the condensed refrigerant to the indoor heat exchangers 110 and 110'.

The compressor 220 is included in the outdoor unit 200. The compressor 220 compresses refrigerant and discharges the compressed refrigerant to the indoor heat exchangers 110 and 110' or the outdoor heat exchanger 210. In more detail, the compressor 220 compresses refrigerant and discharges the compressed refrigerant to the indoor heat exchangers 110 and 110' in heating mode and to the outdoor heat exchanger 210 in cooling mode.

The outdoor unit 200 further includes a linear expansion valve 230. In heating mode, the linear expansion valve 230 of the outdoor unit 200 expands refrigerant condensed by the indoor heat exchangers 110 and 110' and transfers the refrigerant to the outdoor heat exchanger 210. In cooling mode, the linear expansion valve 230 of the outdoor unit 200 is closed, or the opening of the opened linear expansion valve 230 is adjusted.

The outdoor unit 200 further includes a parallel pipe 240 and a check valve 250. The parallel pipe 240 is connected in parallel to a refrigerant pipe through which refrigerant flows to the outdoor heat exchanger 210 in heating mode. The check valve 250 is disposed at the parallel pipe 240.

The outdoor unit 200 further includes a four-way valve 260. The four-way valve 260 is disposed at refrigerant pipes through which refrigerant compressed by the compressor 220 flows. In heating mode, the four-way valve 260 is positioned in a manner such that refrigerant compressed by the compressor 220 can flow to the indoor heat exchangers 110 and 110' and refrigerant evaporated by the outdoor heat exchanger 210 can flow to the compressor 220. In cooling mode, the four-way valve 260 is positioned in a manner such that refrigerant compressed by the compressor 220 can be discharged to the outdoor heat exchanger 210 and refrigerant condensed by the outdoor heat exchanger 210 can be transferred to the indoor heat exchangers 110 and 110'.

The outdoor unit 200 further includes first to third connection pipes 271, 273, and 275. The first connection pipe 271 connects the outdoor heat exchanger 210 and the refrigerant heating device 300. In heating mode, refrigerant evaporated by the outdoor heat exchanger 210 flows to the refrigerant heating device 300 through the first connection pipe 271. The second connection pipe 273 connects the refrigerant heating device 300 to a refrigerant pipe connected from the indoor heat exchangers 110 and 110' to the outdoor heat exchanger 210. In heating mode, refrigerant condensed by the indoor heat exchangers 110 and 110' flows to the refrigerant heating device 300 through the second connection pipe 273. The third connection pipe 275 connects the compressor 220 and the refrigerant heating device 300. In heating mode, refrigerant heated by the refrigerant heating device 300 flows to the compressor 220 through the third connection pipe 275.

The outdoor unit 200 further includes first and second valves 281 and 283. The first valve 281 is disposed at the first connection pipe 271. In heating mode, the first valve 281 is closed if the refrigerant heating device 300 is used to heat refrigerant. The first valve 281 is opened in cooling mode or in heating mode if the refrigerant heating device 300 is not used. The second valve 283 is disposed at the second connection pipe 273. The second valve 283 is opened in heating mode if the refrigerant heating device 300 is used to heat refrigerant. The second valve 283 is closed in cooling mode or in heating mode if the refrigerant heating device 300 is not used.

The outdoor unit 200 further includes a bypass pipe 291 and a third valve 293. The bypass pipe 291 connects the first connection pipe 271 with a refrigerant pipe through which refrigerant discharged from the compressor 220 flows toward the indoor heat exchangers 110 and 110' in heating mode. The bypass pipe 291 provides a flow path for refrigerant compressed by the compressor 220 and discharged toward the outdoor heat exchanger 210. The third valve 293 is disposed at the bypass pipe 291. The third valve 293 is opened when refrigerant accumulated in the outdoor heat exchanger 210 is re-circulated in a heat exchange cycle.

In heating mode, the refrigerant heating device 300 heats refrigerant evaporated by the outdoor heat exchanger 210. For this, the refrigerant heating device 300 includes an auxiliary heat exchanger 310 and a heating unit 320.

In more detail, refrigerant flows from the first connection pipe 271 or the second connection pipe 273 to the inside of the auxiliary heat exchanger 310. The heating unit 320 heats the auxiliary heat exchanger 310 so that refrigerant flowing through the auxiliary heat exchanger 310 can be heated.

An exemplary operation of the air conditioning system will now be described in detail according to the first embodiment.

Referring to FIG. 1, in a heating mode using the refrigerant heating device 300, the linear expansion valve 230, the first valve 281, and the third valve 293 of the outdoor unit 200 are closed, and the second valves 283 of the outdoor unit 200 is opened. The heating unit 320 is operated to heat refrigerant flowing through the auxiliary heat exchanger 310. Therefore, during a heat exchange cycle, refrigerant is heated by the refrigerant heating device 300 and then directed to the compressor 220. At this time, the four-way valve 260 is in a heating-mode position.

In more detail, refrigerant compressed by the compressor 220 is discharged to the indoor heat exchangers 110 and 110' through the four-way valve 260. Then, at the indoor heat exchangers 110 and 110', the refrigerant exchanges heat with indoor air and condenses. Therefore, indoor areas can be heated.

Next, the refrigerant condensed at the indoor heat exchangers 110 and 110' passes through the linear expansion valves 120 and 120' of the indoor units 100 and 100' and flows to the auxiliary heat exchanger 310 through the second connection pipe 273. At this time, while the refrigerant flows in the second connection pipe 273 toward the auxiliary heat exchanger 310, the refrigerant expands at the second valve 283. Then, the refrigerant reaches the auxiliary heat exchanger 310 where the refrigerant is heated by the heating unit 320 and is discharged to the third connection pipe 275. The refrigerant flows from the third connection pipe 275 to the compressor 220, thereby completing one cycle of heat exchange. At this time, since the third valve 293 is in a closed state, the refrigerant compressed at the compressor 220 is not discharged to the outdoor heat exchanger 210 through the bypass pipe 291. Furthermore, owing to the check valve 250, the refrigerant compressed at the compressor 220 is not discharged to the outdoor heat exchanger 210 through the parallel pipe 240.

Referring to FIG. 2, in a heating mode using the refrigerant heating device 300, the opened linear expansion valve 230, the second valve 283, and the third valve 293 of the outdoor unit 200 are opened, and the first valve 281 of the outdoor unit 200 is closed. Therefore, some of refrigerant compressed by the compressor 220 is discharged to the outdoor heat exchanger 210 through the bypass pipe 291.

In more detail, refrigerant compressed by the compressor 220 is discharged to the indoor heat exchangers 110 and 110' where the refrigerant is condensed. The refrigerant condensed at the indoor heat exchangers 110 and 110' is transferred to the auxiliary heat exchanger 310 and heated by the heating unit 320. Then, the refrigerant is sucked by the compressor 220.

Meanwhile, some of the refrigerant compressed by the compressor 220 is transferred to the first connection pipe 271 through the bypass pipe 291. At this time, since the first valve 281 is closed, the refrigerant transferred to the first connection pipe 271 is directed to the outdoor heat exchanger 210. Since the opened linear expansion valve 230 of the outdoor unit 200 is opened, the refrigerant, together with refrigerant accumulated in the outdoor heat exchanger 210, flows from the outdoor heat exchanger 210 to a refrigerant pipe connected from the outdoor heat exchanger 210 to the indoor heat exchangers 110 and 110' and to the parallel pipe 240 where the check valve 250 is disposed. However, refrigerant condensed at the indoor heat exchangers 110 and 110' flows toward the outdoor heat exchanger 210 through the refrigerant pipe connected from the outdoor heat exchanger 210 to the indoor heat exchangers 110 and 110'. Therefore, the refrigerant transferred to the outdoor heat exchanger 210 through the bypass pipe 291 and the first connection pipe 271, and the refrigerant accumulated in the outdoor heat exchanger 210 are transferred to the auxiliary heat exchanger 310 through the second connection pipe 273 after they flow along some length of the refrigerant pipe connected from the outdoor heat exchanger 210 to the indoor heat exchangers 110 and 110'. Then, the refrigerant transferred to the auxiliary heat exchanger 310 is heated by the heating unit 320 and sucked by the compressor 220.

Refrigerant accumulated in the outdoor heat exchanger 210 may be re-circulated in this way when insufficient refrigerant circulates in a heat exchange cycle. For example, when the temperature of refrigerant discharged from the compressor 220 is equal to or higher than a reference temperature, it may be determined that the amount of refrigerant circulating in the heat exchange cycle is insufficient.

Referring to FIG. 3, in cooling mode, the opening of the linear expansion valve 230 is adjusted, and the first valve 281 is opened but the second and third valves 283 and 293 are closed. The heating unit 320 is not operated such that refrigerant flowing through the auxiliary heat exchanger 310 is not heated. That is, during heat exchange cycles, refrigerant is not heated by the refrigerant heating device 300. The four-way valve 260 is shifted to a cooling-mode position.

In more detail, refrigerant compressed by the compressor 220 is discharged to the outdoor heat exchanger 210. At the outdoor heat exchanger 210, the refrigerant is condensed by heat exchange with outdoor air.

The refrigerant condensed at the outdoor heat exchanger 210 is transferred to the indoor heat exchangers 110 and 110'. While the refrigerant is transferred from the outdoor heat exchanger 210 to the indoor heat exchangers 110 and 110', the refrigerant is expanded by the linear expansion valves 120 and 120' of the indoor units 100 and 100'.

At the indoor heat exchangers 110 and 110', the refrigerant is evaporated by heat exchange with indoor air. Therefore, the indoor areas can be cooled by heat exchange between the indoor air and the refrigerant at the indoor heat exchangers 110 and 110'.

After the heat exchange, the refrigerant is transferred from the indoor heat exchangers 110 and 110' to the compressor 220 through the four-way valve 260. The compressor 220 compresses the refrigerant and discharges the compressed refrigerant to the auxiliary heat exchanger 310. At this time, since the heating unit 320 is not operated, the refrigerant discharged to the auxiliary heat exchanger 310 is not heated by the heating unit 320.

Meanwhile, since the first valve 281 is opened, the refrigerant is discharged from the auxiliary heat exchanger 310 to the outdoor heat exchanger 210 through the first connection pipe 271. At the outdoor heat exchanger 210, the refrigerant is condensed by heat exchange with outdoor air. The condensed refrigerant is transferred to the indoor heat exchangers 110 and 110' through the refrigerant pipe connected from the outdoor heat exchanger 210 to the indoor heat exchangers 110 and 110', and the parallel pipe 240 connected in parallel to the refrigerant pipe.

An air conditioning system will now be described in detail with reference to the accompanying drawing according to a second embodiment.

Figure 4:
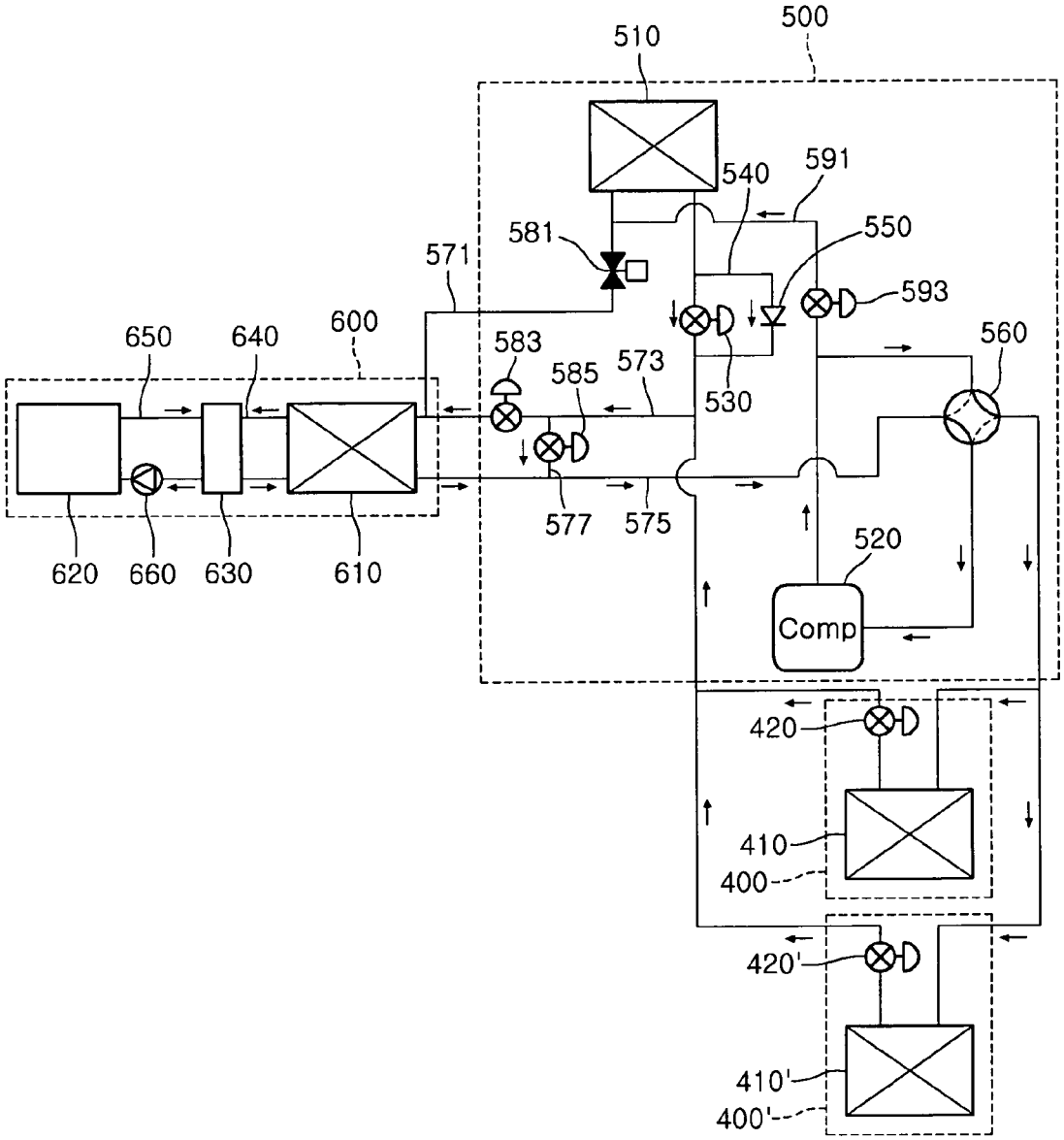
FIG. 4 is view for illustrating flows of refrigerant in an air conditioning system when the air conditioning system is operated in heating mode according to a second embodiment.

FIG. 4 is view for illustrating flows of refrigerant in an air conditioning system when the air conditioning system is operated in heating mode according to a second embodiment. In the current embodiment, similar elements as those in the first embodiment will not be described in detail.

Referring to FIG. 4, in the current embodiment, a outdoor unit 200 includes a bypass pipe 577 (hereinafter, referred to as a second bypass pipe to distinguish it from a bypass pipe 591) and a fourth valve 585. The second bypass pipe 577 is connected between second and third connection pipe 573 and 575. In heating mode, some of refrigerant condensed at indoor heat exchangers 410 and 410' and transferred to a refrigerant heating device 600 is bypassed through the second bypass pipe 577. That is, some of refrigerant flowing through the second connection pipe 573 is bypassed to the third connection pipe 575 through the second bypass pipe 577. In heating mode, the fourth valve 585 is opened if the refrigerant heating device 600 is used to heat refrigerant and is closed if the refrigerant heating device 600 is not used to heat refrigerant. In addition, the fourth valve 585 is closed in cooling mode.

The opened areas of a second valve 583 and the fourth valve 585 are adjusted according to the heating load of indoor area. In more detail, if the second valve 583 is less opened and the fourth valve 585 is more opened, the amount of refrigerant bypassed through the bypass pipe 577 is increased. On the other hand, if the second valve 583 is more opened and the fourth valve 585 is less opened, the amount of refrigerant bypassed through the bypass pipe 577 is decreased.

Referring to FIG. 4, in the current embodiment, a refrigerant heating device 600 includes an auxiliary heat exchanger 610, a heating unit 620, a heat exchange unit 630, a heating pipe 640, a fluid pipe 650, and a pump 660. During a heat exchange cycle, refrigerant is transferred to the auxiliary heat exchanger 610. The heating unit 620 heats a working fluid. At the heat exchange unit 630, the refrigerant transferred to the auxiliary heat exchanger 610 exchanges heat with the working fluid heated by the heating unit 620. The refrigerant transferred to the auxiliary heat exchanger 610 flows through the heating pipe 640, and the working fluid heated by the heating unit 620 circulates through the fluid pipe 650. That is, substantially at the heat exchange unit 630, heat exchange occurs between the refrigerant flowing through the heating pipe 640 and the working fluid circulating through the fluid pipe 650. The pump 660 forces the working fluid to circuit through the fluid pipe 650.

In the current embodiment, other elements of the air conditioning system, such as an indoor heat exchanger 410 and a linear expansion valve 420 of an indoor unit 400, an outdoor heat exchanger 510 of an outdoor unit 500, a compressor 520, a linear expansion valve 530, a parallel pipe 540, a check valve 550, a four-way valve 560, first to third connection pipes 571, 573, and 575, first and second valves 581 and 583, the bypass pipe 591, and a third valve 593, have similar structures as those of the air conditioning system of the first embodiment. Thus, detailed descriptions thereof will be omitted.

An air conditioning system will now be described in detail with reference to the accompanying drawing according to a third embodiment.

Figure 5:
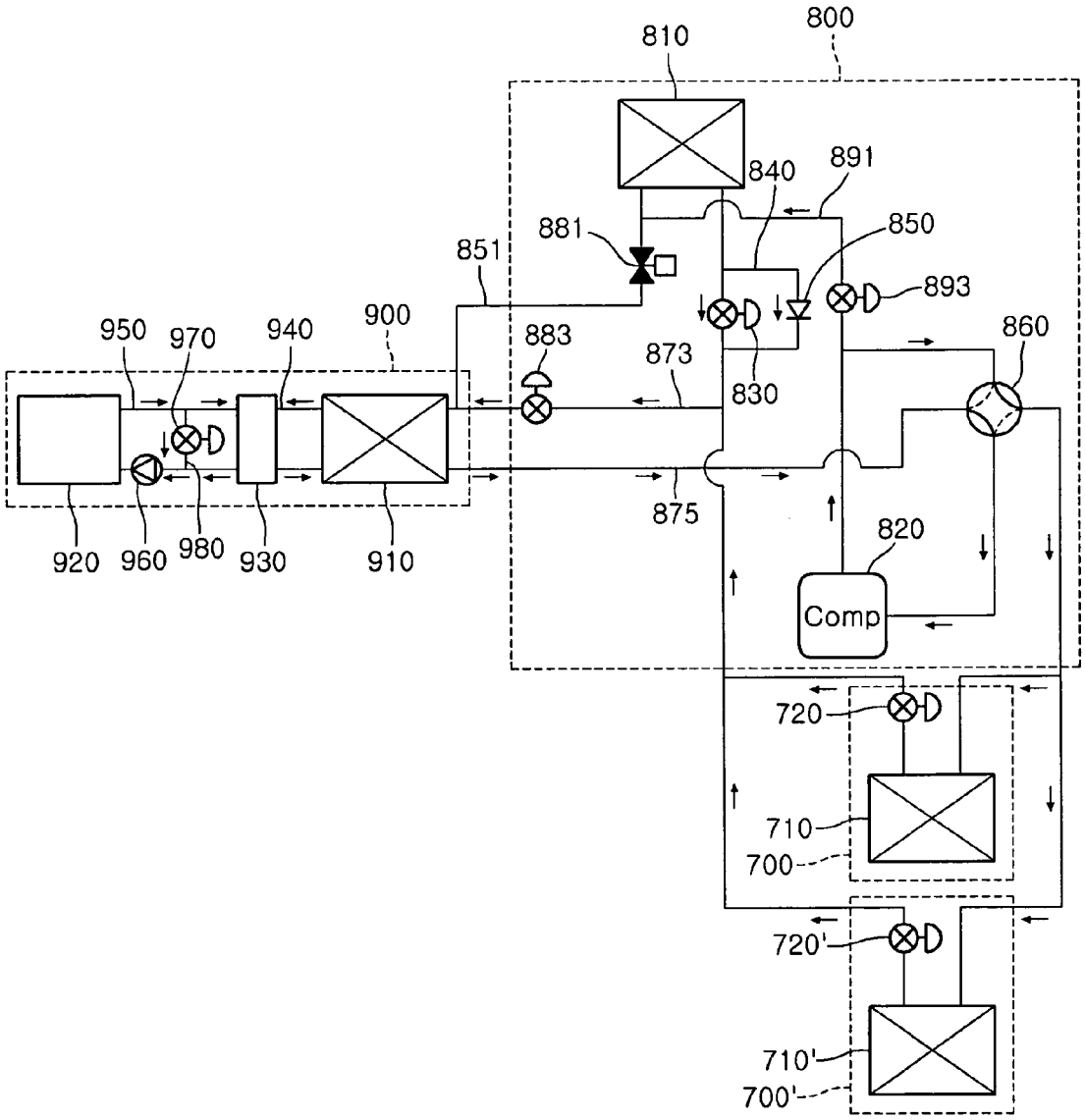
FIG. 5 is a view for illustrating flows of refrigerant in heating mode according to a third embodiment.

FIG. 5 is view for illustrating flows of refrigerant in an air conditioning system when the air conditioning system is operated in heating mode according to a third embodiment. In the current embodiment, similar elements as those in the first embodiment and/or the second embodiment will not be described in detail.

Referring to FIG. 5, in the current embodiment, a refrigerant heating device 900 includes an auxiliary heat exchanger 910, a heating unit 920, a heat exchange unit 930, a heating pipe 940, a fluid pipe 950, and a pump 960. In addition, the refrigerant heating device 900 further includes a second bypass pipe 980 and a fourth valve 970. The auxiliary heat exchanger 910, the heating unit 920, the heat exchange unit 930, the heating pipe 940, the fluid pipe 950, and the pump 960 have similar structures as those in the second embodiment.

The pump 960 forces a working fluid to circulate through the fluid pipe 950 so that refrigerant flowing through the heating pipe 940 can exchange heat with the working fluid at the heat exchange unit 930. At this time, some of the working fluid is bypassed to the heating unit 920 through the second bypass pipe 980.

The fourth valve 970 is disposed at the second bypass pipe 980. The fourth valve 970 is used to adjust heating of the refrigerant flowing through the heating pipe 940 according to the heating load of indoor areas. In more detail, the fourth valve 970 is turned on or off or the opening of the fourth valve 970 is adjusted so as to adjust the amount of working fluid bypassed through the second bypass pipe 980. In other words, if the fourth valve 970 is turned off, the working fluid is not bypassed through the second bypass pipe 980. If the opened area of the fourth valve 970 is increased or decreased, the amount of working fluid bypassed through the second bypass pipe 980 is increased or decreased. Therefore, at the heat exchange unit 930, the amount of working fluid flowing through the fluid pipe 950 for changing heat with the refrigerant flowing through the heating pipe 940 can be adjusted. Accordingly, heating of the refrigerant flowing through the heating pipe 940 can be adjusted. This adjustment of the heating of the refrigerant flowing through the heating pipe 940 may be performed according to the heating load of the indoor areas.

Other elements of the air conditioning system of the current embodiment, such as an indoor heat exchanger 710 and a linear expansion valve 720 of an indoor unit 700, an outdoor heat exchanger 810 of an outdoor unit 800, a compressor 820, a linear expansion valve 830, a parallel pipe 840, a check valve 850, a four-way valve 860, first to third connection pipes 851, 873, and 875, first and second valves 881 and 883, a bypass pipe 891, and a third valve 893, have similar structures as those of the air conditioning systems of the first and second embodiments. Thus, detailed descriptions thereof will be omitted.

As described above, according to the air conditioning system of the present disclosure, if refrigerant is heated by the refrigerant heating device in heating mode, some of refrigerant compressed by the compressor is bypassed to the outdoor heat exchanger. Therefore, owing to the refrigerant bypassed to the outdoor heat exchanger, refrigerant accumulated in the outdoor heat exchanger can be re-circulated in heat exchange cycles so that the amount of refrigerant circulating in the heat exchange cycles does not become insufficient.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner comprising:

a compressor for compressing refrigerant;

an indoor heat exchanger configured to condense refrigerant compressed by the compressor in a heating mode;

an outdoor heat exchanger that discharges evaporated refrigerant;

a four-way valve disposed at an outlet of the compressor to guide refrigerant to one of the indoor heat exchanger and the outdoor heat exchanger according to the heating mode and a cooling mode;

a first pipe coupling the compressor and the four-way valve;

a second pipe coupling the outdoor heat exchanger and the indoor heat exchanger;

a heater;

a third pipe coupling the second pipe and the heater;

a fourth pipe coupling the heater and the four-way valve;

a refrigerant heating device configured to receive the refrigerant from the indoor heat exchanger and heat the received refrigerant; and a bypass pipe configured to connect the first pipe to the outdoor heat exchanger, the bypass pipe guiding at least a portion of the refrigerant compressed by the compressor from the first pipe to the outdoor heat exchanger, wherein the third pipe allows the combined refrigerant to flow to the heater.

2. The air conditioner of claim 1, further comprising a bypass valve at the bypass pipe that opens to allow the outdoor heat exchanger to receive at least the portion of the compressed refrigerant from the compressor.

3. The air conditioner of claim 1, wherein the refrigerant discharged from the indoor heat exchanger can be combined with at least a portion of the refrigerant discharged from the outdoor heat exchanger and the combined refrigerant flows to the refrigerant heating device.

4. The air conditioner of claim 3, further comprising a second valve at the second pipe that opens to allow at least the portion of the refrigerant to be discharged from the outdoor heat exchanger.

5. The air conditioner of claim 4, further comprising a third valve in parallel connection with the second valve.

6. The air conditioner of claim 1, further comprising:

a four-way valve;

a fourth pipe coupling the heater and the four-way valve; and a fifth pipe coupling the third pipe and the fourth pipe, wherein the fifth pipe allows at least a portion of the refrigerant flowing to the heater through the third pipe to be diverted to the fourth pipe.

7. The air conditioner of claim 6, further comprising a fourth valve at the fifth pipe that opens to allow at least the portion of the refrigerant to be diverted from the third pipe to the fourth pipe.

8. The air conditioner of claim 6, wherein the heater further comprises:

a refrigerant heat exchanger;

a heating element;

a sixth pipe and a seventh pipe coupling the refrigerant heat exchanger and the heating element; and an eighth pipe that couples the sixth pipe and the seventh pipe, wherein the eighth pipe allows at least a portion of the refrigerant flowing to the heating element through the sixth pipe to be diverted to the seventh pipe.

9. The air conditioner of claim 8, further comprising a fifth valve at the eighth pipe that opens to allow at least the portion of the refrigerant to be diverted from the sixth pipe to the seventh pipe.

10. The air conditioner of claim 1, further comprising a fifth pipe coupling the refrigerant heating device and the four-way valve, wherein in the heating mode, a portion of the refrigerant compressed by the compressor flows to the outdoor heat exchanger via the bypass pipe, the refrigerant discharged by the outdoor heat exchanger flows to the refrigerant heating device via the fourth pipe, and the heated refrigerant by the heater flows to the four-way valve via the fifth pipe.

11. The air conditioner of claim 1, further comprising:

a four-way valve;

a fifth pipe coupling the second pipe and the heater;

a sixth pipe coupling the fourth pipe and the fifth pipe, wherein the sixth pipe allows at least a portion of the refrigerant flowing to the heater through the fifth pipe to be diverted to the fourth pipe.

12. The air conditioner of claim 11, further comprising a third valve at the fourth pipe that opens to allow at least the portion of the refrigerant to be diverted from the fifth pipe to the fourth pipe.

13. The air conditioner of claim 11, wherein the heater further comprises:

a refrigerant heat exchanger;

a heating element;

a seventh pipe and a eighth pipe coupling the refrigerant heat exchanger and the heating element; and a ninth pipe that couples the seventh pipe and the eighth pipe, wherein the ninth pipe allows at least a portion of the refrigerant flowing to the heating element through the seventh pipe to be diverted to the eighth pipe.

14. The air conditioner of claim 13, further comprising a fifth valve at the ninth pipe that opens to allow at least the portion of the refrigerant to be diverted from the seventh pipe to the eighth pipe.

* * * * *